US012721481B2

(12) United States Patent
Yin

(10) Patent No.: US 12,721,481 B2
(45) Date of Patent: Sep. 1, 2026

(54) PORTABLE FLUSHER WITH FLIP TOP CAP MECHANISM

(71) Applicant: Shenzhen Xiaohongbao Technology Co., Ltd., Shenzhen (CN)

(72) Inventor: Sheng Yin, Shaoyang (CN)

(73) Assignee: Shenzhen Xiaohongbao Technology Co., Ltd., Shenzhen (CN)

( * ) Notice: Subject to any disclaimer, the term of this patent is extended or adjusted under 35 U.S.C. 154(b) by 89 days.

(21) Appl. No.: 19/019,377

(22) Filed: Jan. 13, 2025

(65) Prior Publication Data

US 2026/0096695 A1 Apr. 9, 2026

(30) Foreign Application Priority Data

Oct. 9, 2024 (CN) ..... 202422433258.2

(51) Int. Cl.
*A47K 3/26* (2006.01)
*A47K 7/04* (2006.01)
*A47K 7/08* (2006.01)

(52) U.S. Cl.
CPC ..... *A47K 3/26* (2013.01); *A47K 7/043* (2013.01); *A47K 7/08* (2013.01)

(58) Field of Classification Search
CPC ..... E03D 9/085; A47K 3/26; A47K 7/043; A47K 7/08
See application file for complete search history.

(56) References Cited

U.S. PATENT DOCUMENTS

| | | | | |
|---|---|---|---|---|
| 4,259,754 | A * | 4/1981 | Bader | A47K 3/26 4/443 |
| 6,918,896 | B2 * | 7/2005 | McMurdo | A61M 3/0279 604/295 |
| 8,007,478 | B2 * | 8/2011 | Lu | A47K 7/08 604/279 |
| 2005/0159713 | A1 * | 7/2005 | McPherson | A47K 7/08 604/279 |
| 2006/0207007 | A1 * | 9/2006 | Fogel | A61H 35/00 4/443 |
| 2009/0236341 | A1 * | 9/2009 | McKinney | A47G 19/2266 220/711 |

FOREIGN PATENT DOCUMENTS

CN 219517368 U 8/2023

* cited by examiner

*Primary Examiner* — Christine J Skubinna
(74) *Attorney, Agent, or Firm* — FIDELI LAW PLLC

(57) ABSTRACT

The invention relates to a portable flusher with a flip top cap mechanism, including a bottle body having a liquid storage space therein and a water outlet rod. The bottle body is provided with a bottle mouth communicating with the liquid storage space, the water outlet rod is provided with a connector, the water outlet rod is detachably mounted on the bottle mouth through the connector, the water outlet rod has a liquid outlet channel inside communicating with a water outlet, and the liquid outlet channel communicates with the bottle mouth through the connector. A side surface of the water outlet rod is provided with a water fill port in communication with the liquid outlet channel, and the water fill port is provided with a flip top cap mechanism capable of opening or closing the water fill port.

8 Claims, 9 Drawing Sheets

PORTABLE FLUSHER WITH FLIP TOP CAP MECHANISM

RELATED APPLICATIONS

The present patent document claims the benefit of priority to Patent Application No. 202422433258.2, filed Oct. 9, 2024, and entitled "PORTABLE FLUSHER WITH FLIP TOP CAP MECHANISM," the entire contents of each of which are incorporated herein by reference.

1. Technical Field

The invention relates to the field of medical cleaners, and in particular to a portable flusher with a flip top cap mechanism.

2. Background Information

A portable flusher is a product for washing with water by squeezing a soft rubber bottle body after defecation. Wiping with tissues after defecation cannot thoroughly clean up the excrement, and there is always a small amount of residue. Washing with water using a portable flusher will be cleaner and more hygienic than wiping with tissues. Moreover, it is very painful for people such as patients with hemorrhoids and postoperative patients to wipe with tissues, so washing with water can greatly alleviate their pain.

At present, a user needs to unscrew the bottle cap before filling up the portable flusher on the market with water. Occasionally unscrewing the bottle cap is not very troublesome for the user. However, as a daily product, the portable flusher is used frequently, at least once a day and in some cases 2-3 times a day. Since the portable flusher is used by squeezing, the bottle cap is usually screwed tightly, otherwise, there will be a risk of water leakage at the bottle mouth. Therefore, it takes a lot of effort to unscrew and tightly screw the bottle cap. As the portable flusher is used frequently, screwing and unscrewing the bottle cap becomes troublesome for the user. Especially for people in fragile health such as users with hand injuries, old people and postoperative patients, it becomes a difficult thing to screw and unscrew the bottle cap hard every day. In addition, when the user is in urgent need of going to the toilet because of diarrhea, he has to screw and unscrew the bottle cap with effort while holding in bowel movements, which is also troublesome for the user.

BRIEF SUMMARY

In order to solve the above problems, the invention provides a portable flusher with a flip top cap mechanism.

In order to achieve the above objective, the invention adopts the following technical solution: The invention relates to a portable flusher with a flip top cap mechanism, including a bottle body having a liquid storage space therein and a water outlet rod. The bottle body is provided with a bottle mouth communicating with the liquid storage space, the water outlet rod is provided with a connector, the water outlet rod is detachably mounted on the bottle mouth through the connector, the water outlet rod has a liquid outlet channel inside communicating with a water outlet, and the liquid outlet channel communicates with the bottle mouth through the connector. A side surface of the water outlet rod is provided with a water fill port in communication with the liquid outlet channel, and the water fill port is provided with a flip top cap mechanism capable of opening or closing the water fill port.

Preferably, the flip top cap mechanism includes a bracket and a water fill cap, the bracket is provided with a connection port, the connection port coincides with the water fill port after the bracket is arranged on the water fill port, the water fill cap is mounted at one end of the bracket and rotatable around the bracket, and the connection port is opened or closed by rotating the water fill cap.

Preferably, the water outlet rod is provided with a first mounting groove, the first mounting groove is arranged on the side surface of the water outlet rod, the water fill port is located in the first mounting groove, and the bracket is mounted in the first mounting groove.

Preferably, two ends of the bracket are respectively provided with a rotating base and a fastening groove, the water fill cap is sequentially provided with a rotating shaft column, a plug and a fastener, and the water fill cap is rotatably connected to the bracket through matching between the rotating shaft column and the rotating base; and when the water fill cap closes the connection port, the fastener is fastened with the fastening groove, and the plug is sequentially embedded into the connection port and the water fill port.

Preferably, a wall surface of the fastening groove away from the rotating base is provided with a snap-fit position, the fastener is provided with a snap-fit rib, the snap-fit rib is arranged on an outer side of the fastener, and when the fastener is mounted to the fastening groove, the snap-fit rib enters the snap-fit position to form a snap fit.

Preferably, an end of the fastener extends outward to form a warping plate.

Preferably, the plug is provided with an annular groove, and the annular groove is provided with a sealing ring.

Preferably, the water outlet rod includes a rod body having a second mounting groove and a cover plate closing the second mounting groove, the cover plate and the rod body form the liquid outlet channel, and the cover plate is provided with the water outlet.

The invention has the following beneficial effects: The portable flusher with a flip top cap mechanism according to the invention saves the user from frequently screwing and unscrewing the bottle cap and solves the problem of water leakage. Since the water fill port is provided in the water outlet rod and the water fill port can be opened and closed through the flip top cap mechanism, the user can fill the flusher conveniently simply by opening the water fill cap. When the water fill cap is closed, the plug blocks the water fill port, which avoids water leakage. The portable flusher is convenient and easy to use, and can provide a better user experience.

REFERENCE SIGNS

1. bottle body; 11. bottle mouth; 12. liquid storage space;
2. water outlet rod; 21. connector; 22. liquid outlet channel; 23. water fill port; 24. first mounting groove; 25. water outlet; 26. second mounting groove; 27. strap groove;
3. flip top cap mechanism; 31. bracket; 311. rotating base; 312. connection port; 313. fastening groove; 3131. snap-fit position; 32. water fill cap; 321. rotating shaft column; 322. plug; 3221. annular groove; 323. fastener; 3231. snap-fit rib; 3232. warping plate; 324. sealing ring.

DETAILED DESCRIPTION OF THE DRAWINGS AND THE PRESENTLY PREFERRED EMBODIMENTS

Figure 1:
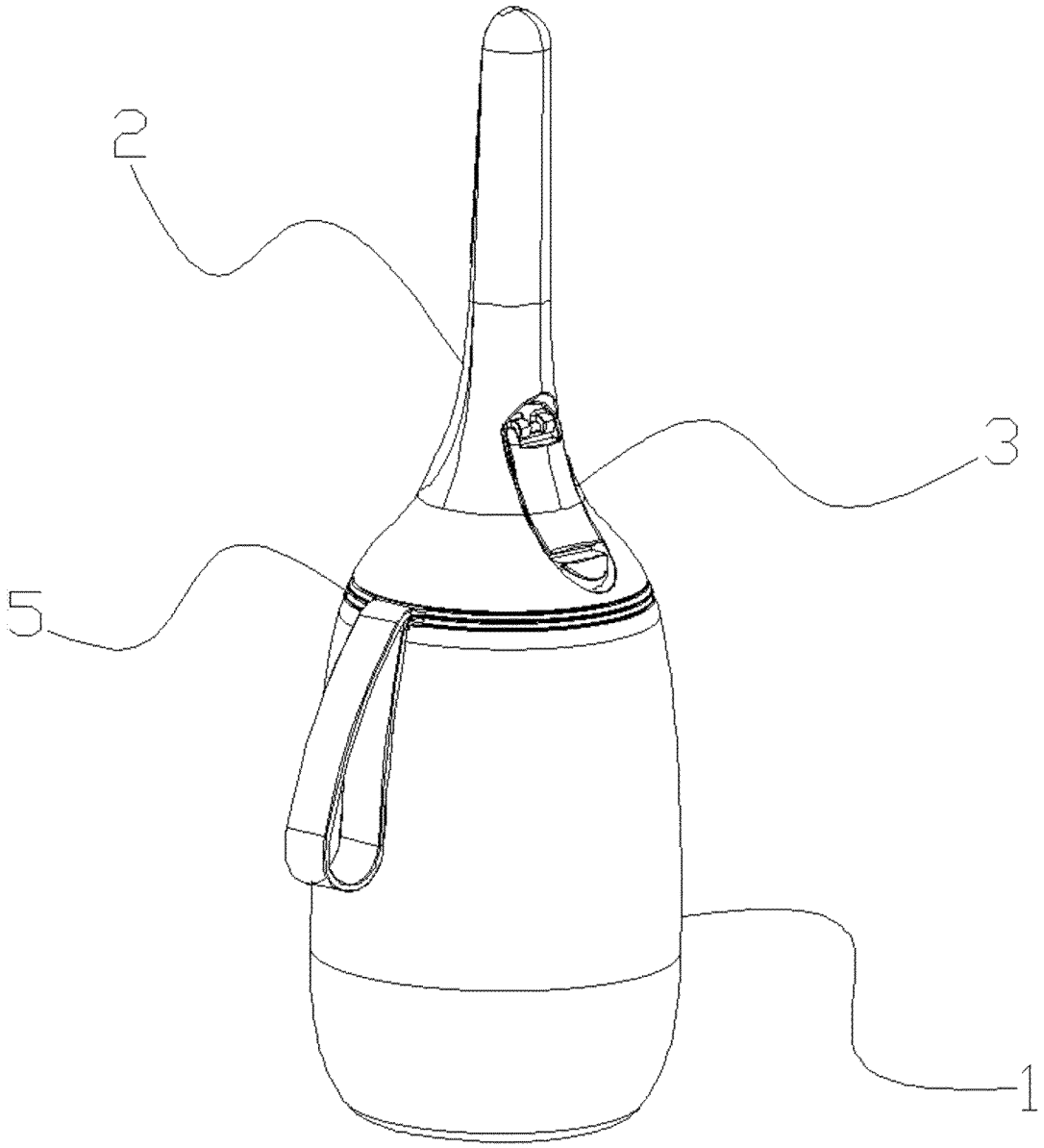
FIG. 1 is a schematic overall structural view of a flusher according to the invention.
Figure 2:
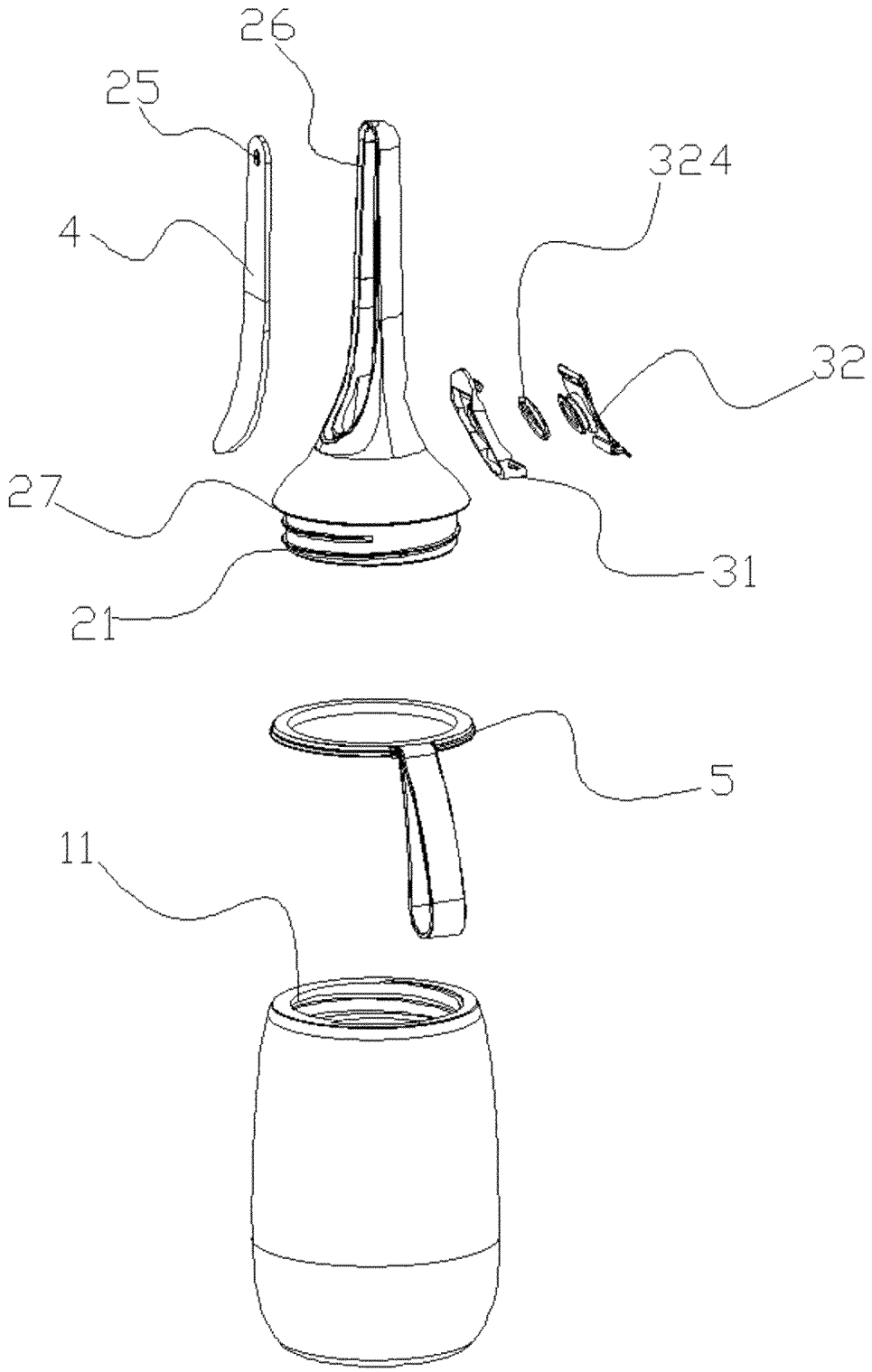
FIG. 2 is a schematic structural exploded view of the flusher according to the invention.
Figure 3:
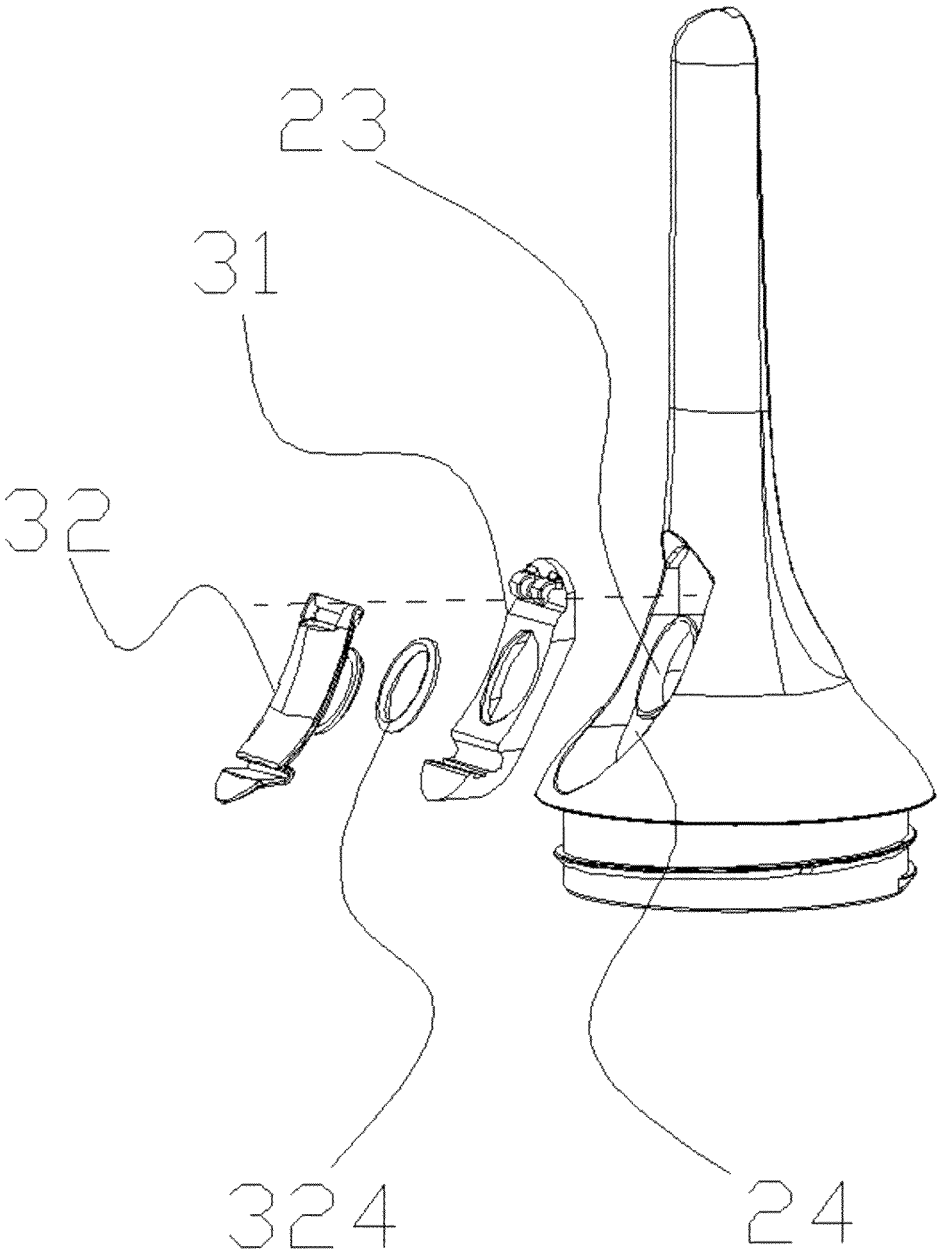
FIG. 3 is a schematic exploded view of a water outlet rod and a flip top cap mechanism according to the invention.
Figure 4:
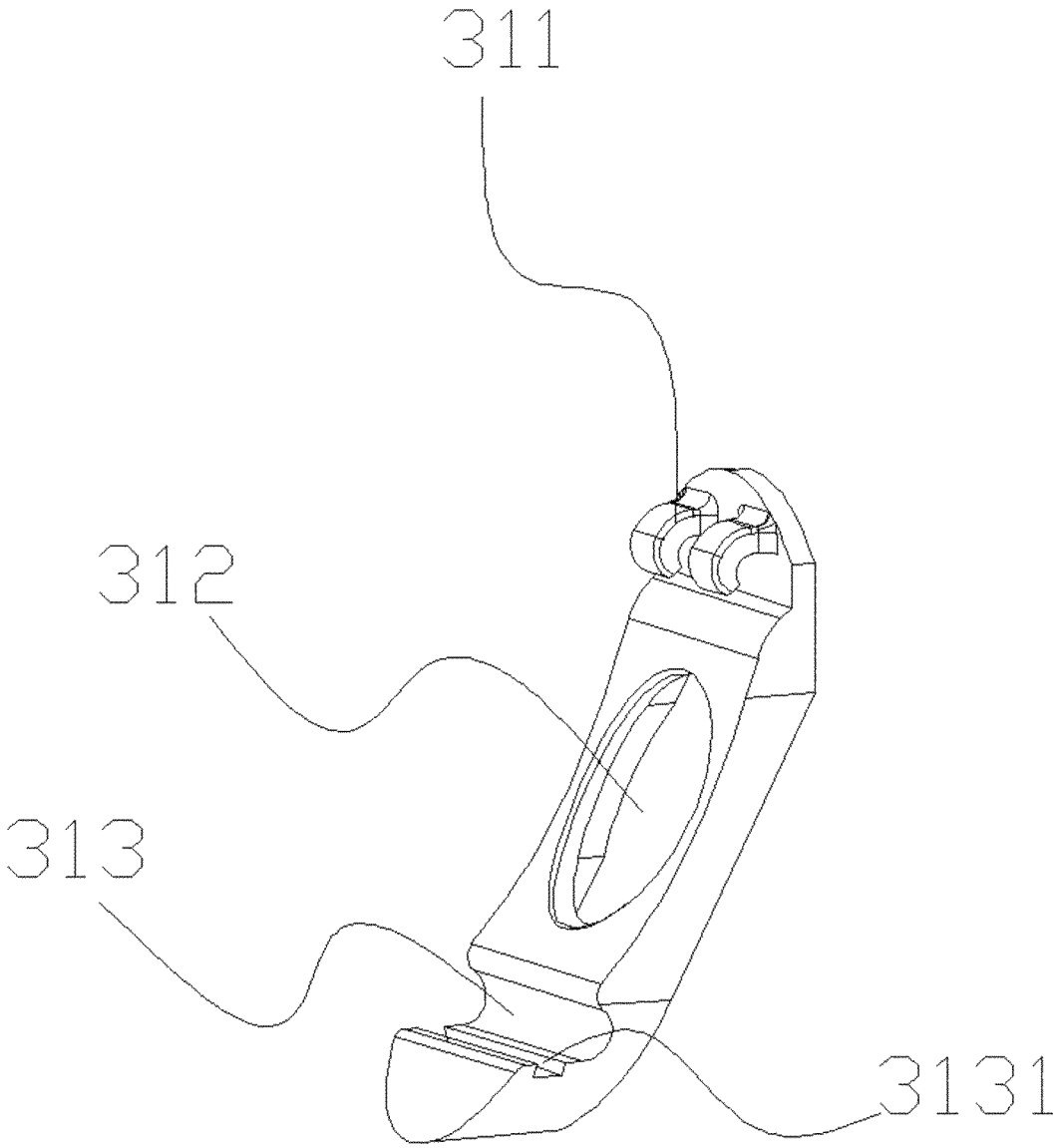
FIG. 4 is a schematic structural view of a bracket according to the invention.
Figure 5:
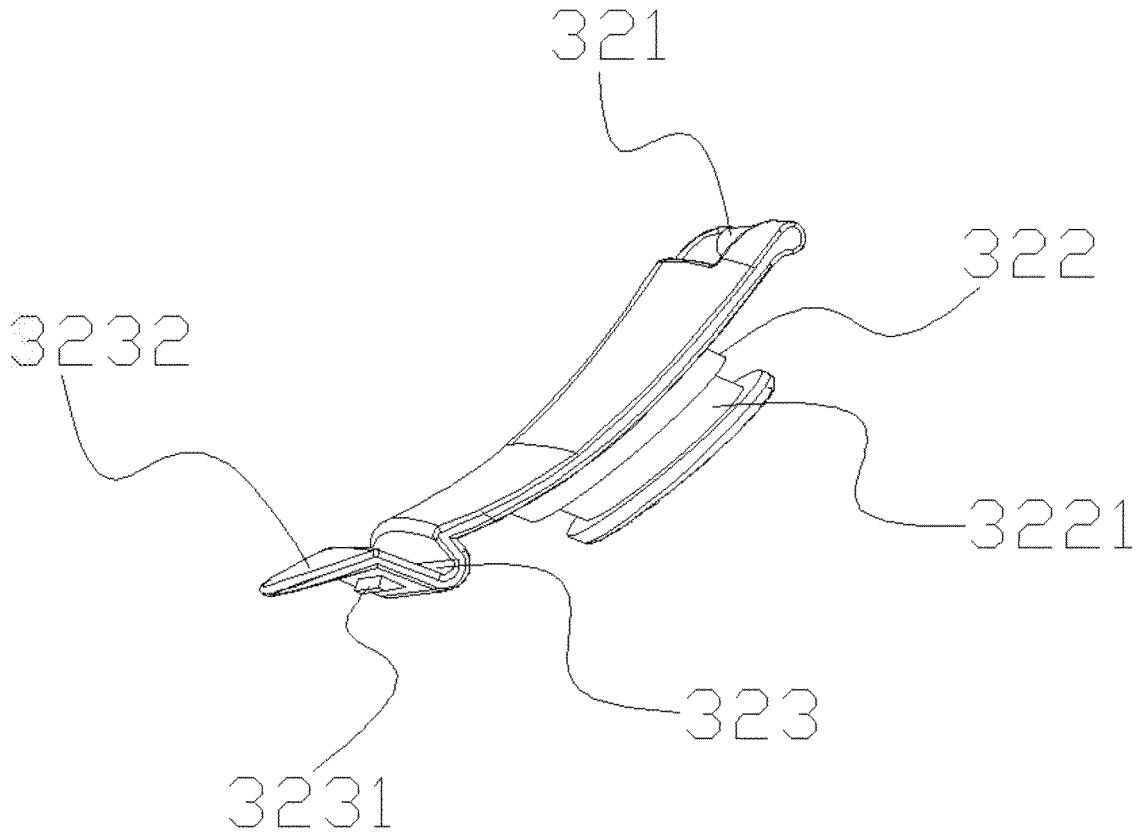
FIG. 5 is a schematic structural view of a water fill cap according to the invention.
Figure 6:
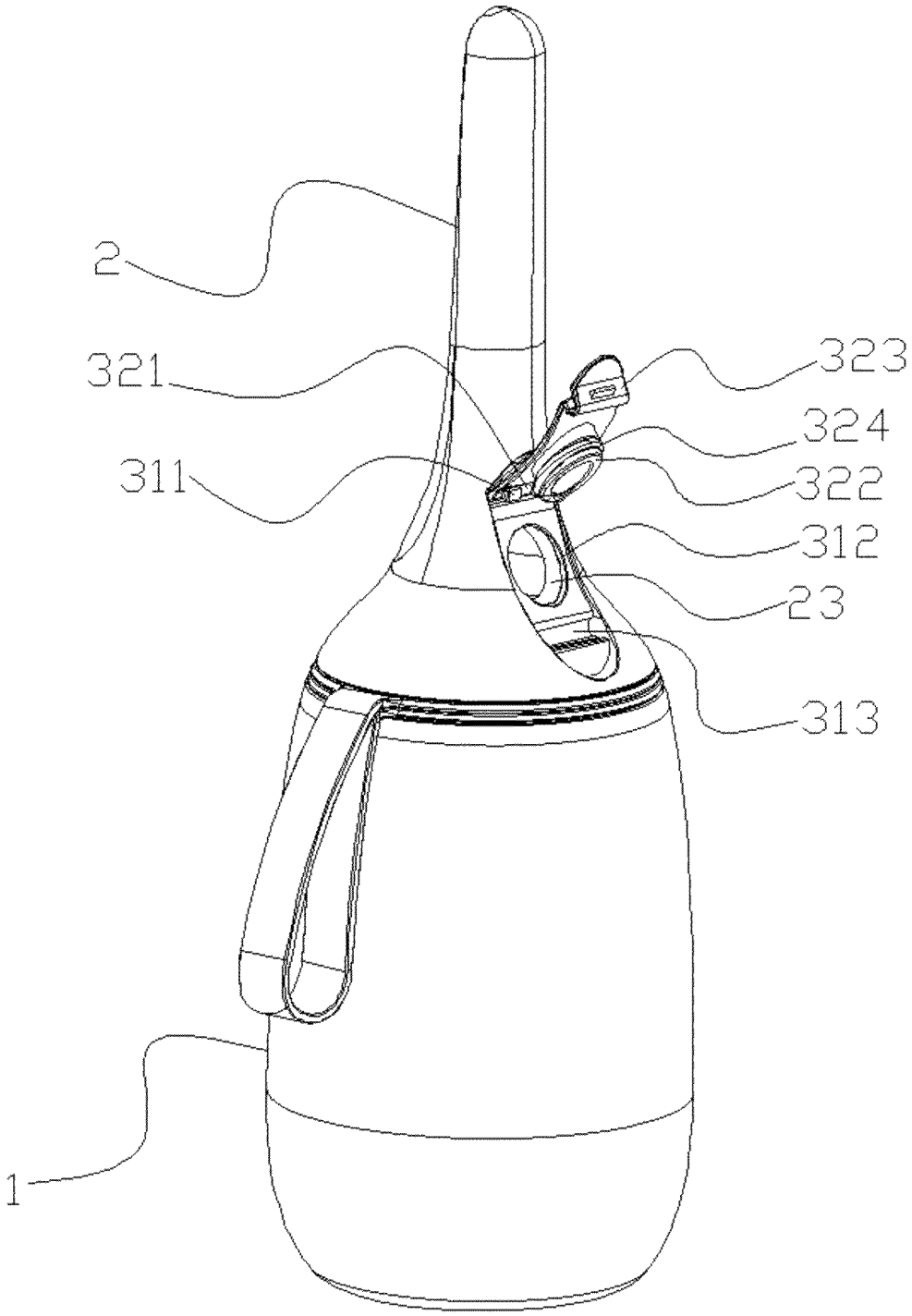
FIG. 6 is a structural view of the flusher when the flip top cap mechanism is opened according to the invention.
Figure 7:
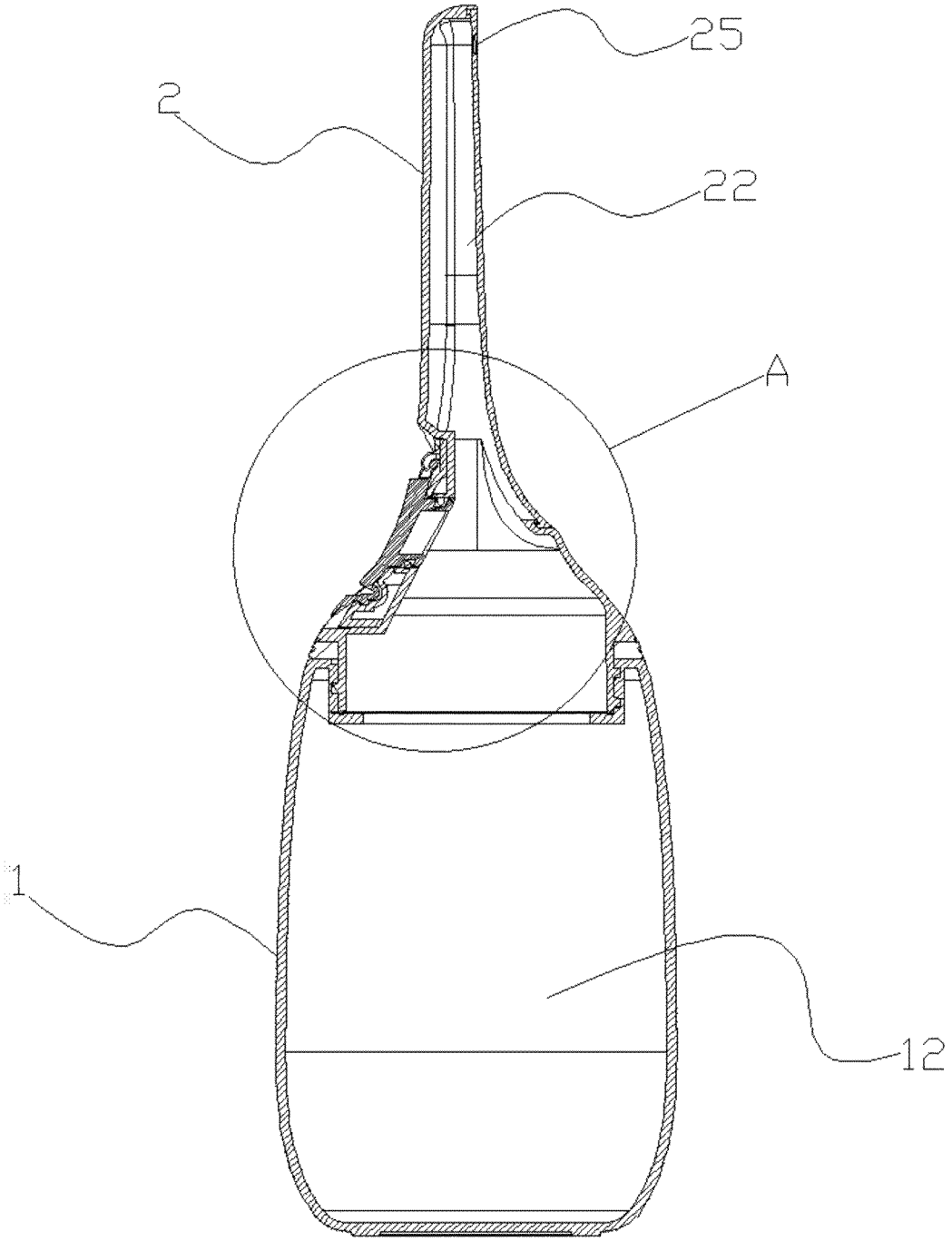
FIG. 7 is a schematic internal structural view of the flusher according to the invention.
Figure 8:
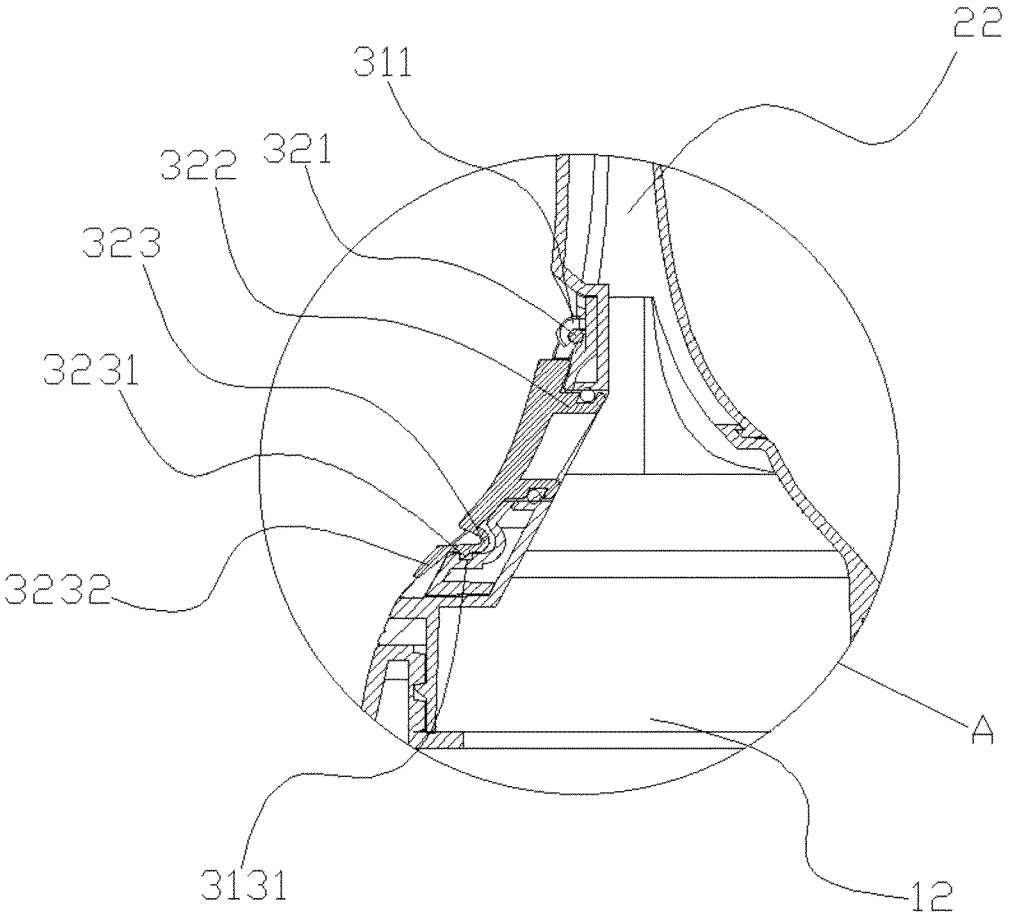
FIG. 8 is a sectional view of A in FIG. 7 when the flip top cap mechanism is closed according to the invention.
Figure 9:
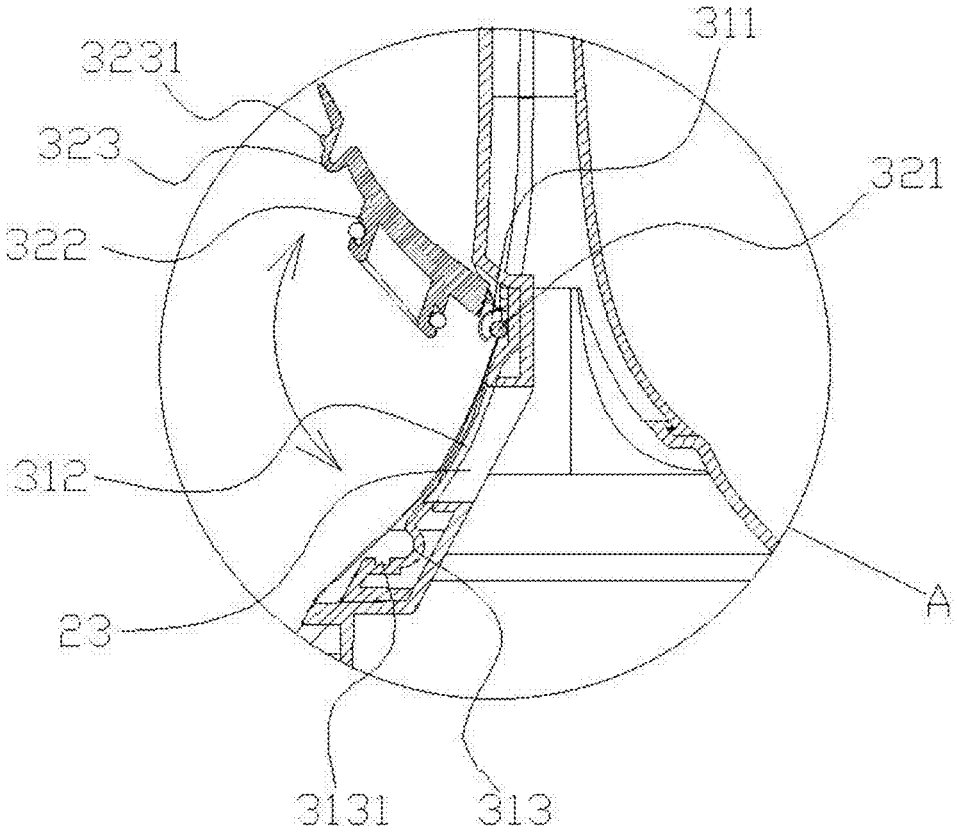
FIG. 9 is a sectional view of A in FIG. 7 when the flip top cap mechanism is opened according to the invention.

Referring to FIG. 1 to FIG. 9, the invention relates to a portable flusher with a flip top cap mechanism, including a bottle body 1, a water outlet rod 2 and a flip top cap mechanism 3 arranged on the water outlet rod 2. The bottle body 1 has a liquid storage space 12 therein for containing a liquid. The bottle body 1 is provided with a bottle mouth 11. The bottle mouth 11 is in communication with the liquid storage space 12. The water outlet rod 2 is provided with a connector 21. The connector 21 is connected to the bottle mouth 11 through threads, so that the water outlet rod 2 is mounted on the bottle body 1. The water outlet rod 2 has a liquid outlet channel 22 inside, and the liquid outlet channel 22 is in communication with the liquid storage space 12. A top of the water outlet rod 2 is provided with a water outlet 25, and the water outlet 25 is in communication with the liquid outlet channel 22. The bottle body 1 is made of soft rubber, the liquid in the liquid storage space 12 is pressurized by squeezing the bottle body 1, and under the action of the pressure, the liquid flows to the liquid outlet channel 22 from the liquid storage space 12 and is finally ejected out of the water outlet 25.

The water outlet rod 2 is provided with a water fill port 23. The water fill port 23 is in communication with the liquid outlet channel 22. The flip top cap mechanism 3 is arranged on the water fill port 23. The flip top cap mechanism 3 includes a bracket 31 and a water fill cap 32. The bracket 31 is provided with a connection port 312. The bracket 31 is mounted on the water fill port 23. The connection port 312 is aligned with the water fill port 23. One end of the water fill cap 32 is rotatably mounted on one side of the connection port 312. The connection port 312 is opened or closed through the water fill cap 32.

Further, the water outlet rod 2 is provided with a first mounting groove 24, the first mounting groove 24 is arranged on the side surface of the water outlet rod 2, the water fill port 23 is arranged in the first mounting groove 24, and the bracket 31 is mounted in the first mounting groove 24. When squeezing the bottle body 1, since the liquid flows vertically upward toward the water outlet 25, arranging the first mounting groove 24 on the side surface of the water outlet rod 2 is beneficial to reducing the liquid impact on the flip top cap mechanism 3 and preventing the flip top cap mechanism 3 from being pushed open.

Further, the bracket 31 is provided with a rotating base 311 and a fastening groove 313, and the rotating base 311 and the fastening groove 313 are respectively arranged at two ends of the connection port 312. In this example, the fastening groove 313 is a U-shaped groove, and a wall surface of the fastening groove 313 away from the rotating base 311 is provided with a snap-fit position 3131.

In this example, the water fill cap 32 is made of soft rubber, the water fill cap 32 is sequentially provided with a rotating shaft column 321, a plug 322 and a fastener 323, the rotating shaft column 321 and the fastener 323 are respectively at two sides of the water fill cap 32, the plug 322 is arranged between the rotating shaft column 321 and the fastener 323, and the plug 322 is arranged at a bottom of the water fill cap 32. The rotating shaft column 321 is rotatably connected to the rotating base 311, and when the water fill cap 32 closes the connection port 312, the fastener 323 is fastened with the fastening groove 313, and the plug 322 is embedded into the connection port 312 to block the connection port 312. When the water fill cap 32 opens the connection port 312, the fastener 323 is separated from the fastening groove 313, and the plug 322 is away from the connection port 312.

A shape of the fastener 323 is matched with that of the fastening groove 313, and the fastener 323 is fastened in the fastening groove 313. The fastener 323 is provided with a snap-fit rib 3231, the snap-fit rib 3231 is arranged on an outer side of the fastener 323, and when the fastener 323 is mounted to the fastening groove 313, the snap-fit rib 3231 enters the snap-fit position 3131 to form a snap fit. In this example, an end of the fastener 323 extends outward to form a warping plate 3232 for separating the snap-fit rib 3231 from the snap-fit position 3131. When the fastener 323 needs to be pulled out of the fastening groove 313, since the water fill cap 32 made of soft rubber can undergo elastic deformation, the warping plate 3232 may be pushed inward by a small distance to drive the snap-fit rib 3231 to be separated from the snap-fit position 3131, so that the fastener 323 can be pulled out.

A cross section of the plug 322 is matched with that of the connection port 312, the plug 322 is provided with an annular groove 3221, the annular groove 3221 is provided with a sealing ring 324, and when the water fill cap 32 is closed, the liquid can be prevented from spillover.

When the water fill cap 32 is closed, the fastener 323 is fastened in the fastening groove 313, the snap-fit rib 3231 is in a snap fit with the snap-fit position 3131, the plug 322 is embedded in the connection port 312, and the plug 322 blocks the connection port 312, so that the liquid cannot flow out. When the water fill cap 32 needs to be opened, the warping plate 3232 is pushed inward by a small distance to drive the snap-fit rib 3231 to be separated from the snap-fit position 3131. At this time, the water fill cap 32 can be rotated open, and the water fill cap 32 drives the plug 322 away from the connection port 312, so that the water fill cap is opened.

Further, the water outlet rod 2 further includes a cover plate 4, and the water outlet 25 is arranged in the cover plate 4. In this example, the water outlet rod 2 is provided with a second mounting groove 26, the second mounting groove 26 communicates with the liquid outlet channel 22, and the cover plate 4 is mounted in the second mounting groove 26.

Further, the connector 21 of the water outlet rod 2 is provided with a strap groove 27, and the strap groove 27 is used for mounting a strap 5, which improves the portability of the flusher.

The portable flusher with a flip top cap mechanism according to the invention saves the user from frequently screwing and unscrewing the bottle cap and solves the problem of water leakage. Since the water outlet rod 2 is provided with the flip top cap mechanism 3, the user can fill the flusher conveniently simply by opening the water fill cap. When the water fill cap is closed, the plug 322 blocks the water fill port 23, which avoids water leakage. The portable flusher is convenient and easy to use, and can provide a better user experience.

The above embodiments only describe the preferred embodiments of the invention, and are not intended to limit the scope of the invention. Various modifications and improvements made by those of ordinary skills in the art to the technical solution of the invention without departing from the design spirit of the invention shall fall within the scope of protection determined by the claims of the invention.

The invention claimed is:

1. A portable flusher with a flip top cap mechanism, comprising a bottle body having a liquid storage space therein and a water outlet rod, wherein the bottle body is provided with a bottle mouth communicating with the liquid storage space, the water outlet rod is provided with a connector, the water outlet rod is detachably mounted on the bottle mouth through the connector, the water outlet rod has a liquid outlet channel inside communicating with a water outlet, and the liquid outlet channel communicates with the bottle mouth through the connector; wherein a side surface of the water outlet rod is provided with a water fill port in communication with the liquid outlet channel, and the water fill port is provided with a flip top cap mechanism capable of opening or closing the water fill port.

2. The portable flusher with a flip top cap mechanism according to claim 1, wherein the flip top cap mechanism comprises a bracket and a water fill cap, the bracket is provided with a connection port, the connection port coincides with the water fill port after the bracket is arranged on the water fill port, the water fill cap is mounted at one end of the bracket and rotatable around the bracket, and the connection port is opened or closed by rotating the water fill cap.

3. The portable flusher with a flip top cap mechanism according to claim 1, wherein the water outlet rod is provided with a first mounting groove, the first mounting groove is arranged on the side surface of the water outlet rod, the water fill port is located in the first mounting groove, and the bracket is mounted in the first mounting groove.

4. The portable flusher with a flip top cap mechanism according to claim 2, wherein two ends of the bracket are respectively provided with a rotating base and a fastening groove, the water fill cap is sequentially provided with a rotating shaft column, a plug and a fastener, and the water fill cap is rotatably connected to the bracket through matching between the rotating shaft column and the rotating base; and when the water fill cap closes the connection port, the fastener is fastened with the fastening groove, and the plug is sequentially embedded into the connection port and the water fill port.

5. The portable flusher with a flip top cap mechanism according to claim 4, wherein a wall surface of the fastening groove away from the rotating base is provided with a snap-fit position, the fastener is provided with a snap-fit rib, the snap-fit rib is arranged on an outer side of the fastener, and when the fastener is mounted to the fastening groove, the snap-fit rib enters the snap-fit position to form a snap fit.

6. The portable flusher with a flip top cap mechanism according to claim 4, wherein an end of the fastener extends outward to form a warping plate.

7. The portable flusher with a flip top cap mechanism according to claim 4, wherein the plug is provided with an annular groove, and the annular groove is provided with a sealing ring.

8. The portable flusher with a flip top cap mechanism according to claim 1, wherein the water outlet rod comprises a rod body having a second mounting groove and a cover plate closing the second mounting groove, the cover plate and the rod body form the liquid outlet channel, and the cover plate is provided with the water outlet.

* * * * *